US006761614B2

(12) United States Patent
Pinna

(10) Patent No.: US 6,761,614 B2
(45) Date of Patent: Jul. 13, 2004

(54) SELF-SUSTAINING FEMALE BREAST SUPPORT

(75) Inventor: Marco Pinna, Induno Olona (IT)

(73) Assignee: Biofarm SRL, Milan (IT)

( * ) Notice: Subject to any disclaimer, the term of this patent is extended or adjusted under 35 U.S.C. 154(b) by 0 days.

(21) Appl. No.: 10/141,980

(22) Filed: May 10, 2002

(65) Prior Publication Data

US 2002/0187727 A1 Dec. 12, 2002

(30) Foreign Application Priority Data

Jun. 6, 2001 (IT) ..... MI2001A1194

(51) Int. Cl.[7] ..... A41C 3/00
(52) U.S. Cl. ..... 450/81; 450/41
(58) Field of Search ..... 450/81, 88, 39–41, 450/47, 51, 52, 60, 61, 80, 92, 93, 53–57; 2/463, 92, 267, 268, 255, 256, 258, 259, 260, 261, 264, 44, 45

(56) References Cited

U.S. PATENT DOCUMENTS 2,079,426 A * 5/1937 Schottenfels ..... 450/81
2,793,369 A * 5/1957 Panighini ..... 450/86
2,844,151 A * 7/1958 Lemons ..... 450/86
2,869,553 A * 1/1959 D'or ..... 450/81
3,280,818 A * 10/1966 Pankey et al. ..... 450/81
3,934,593 A * 1/1976 Mellinger ..... 450/81
5,755,611 A * 5/1998 Noble et al. ..... 450/39
6,257,951 B1 * 7/2001 DeMarco ..... 450/86 X

* cited by examiner

*Primary Examiner*—Gloria M. Hale
(74) *Attorney, Agent, or Firm*—Oblon, Spivak, McClelland, Maier & Neustadt, P.C.

(57) ABSTRACT

A self-sustaining female breast support, formed from a thin, flexible, soft, elongate sheet of shaped profile made from synthetic material, one of its surfaces being at least partly covered by a thin layer of skin-compatible adhesive, on its other surface there resting an elongate sprung bar formed of semi-rigid synthetic material, its two ends being fixed to the flexible sheet, the adhesive layer being made to adhere to the lower part of the breast, which is widened and maintained raised by the action of the sprung bar in the manner of a leaf spring.

11 Claims, 1 Drawing Sheet

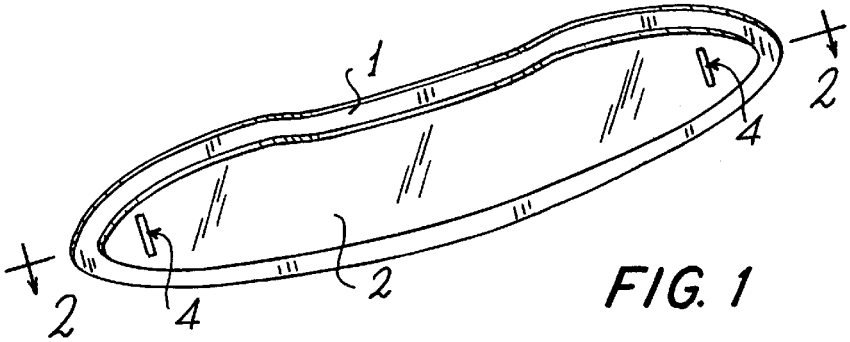
FIG. 1
FIG. 2
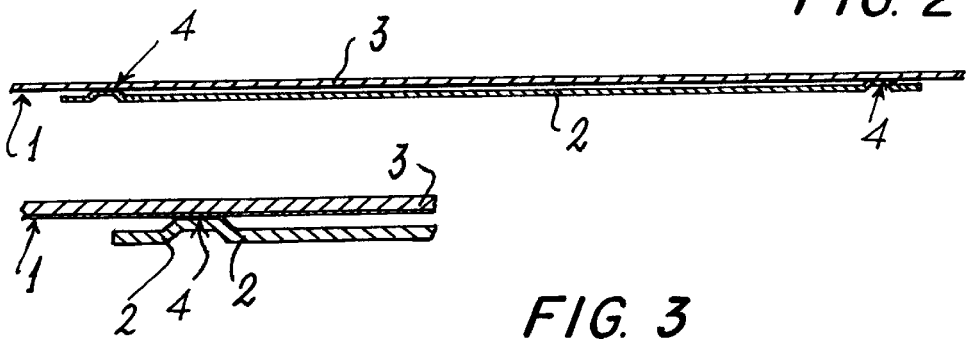
FIG. 3
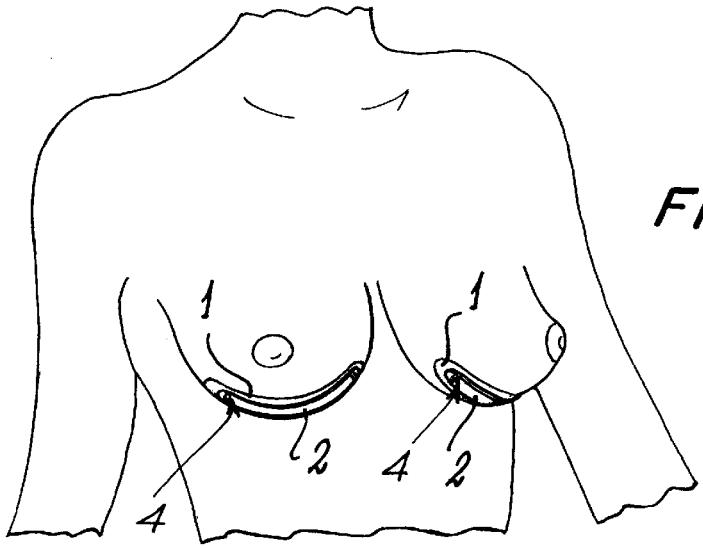
FIG. 4

SELF-SUSTAINING FEMALE BREAST SUPPORT

The invention relates to a self-sustaining female breast support, i.e. a breast support which can be directly applied to the skin on the lower part of the breast to support it in an upward direction without the need for assistance by supplementary or auxiliary devices.

It is well known that with the passage of time, the female breast tends to slope downwards as a result of natural and progressive yielding of the muscular masses and skin of the breast.

Leaving out of consideration those surgical interventions to which women increasingly more frequently subject themselves to improve the outer appearance of their breast, it is common practice to use prostheses or accessories of various kinds applied below the breast to lift it or to make it assume the desired shape. These accessories are themselves supported by corselets, straps, shoulder straps or the like, they are costly and very often their presence is easily noted from the outside.

The main object of the present invention is to provide a self-sustaining female breast support which is of low cost, easy to apply, highly functional, and of which the presence is virtually unnoticeable by an external observer.

This and further objects are attained by a breast support comprising a thin, flexible, elongate sheet of shaped profile, having a thickness between 20 and 150 micron and formed of soft synthetic material, a thin layer of skin-compatible adhesive at least partly covering a surface of said sheet, and an elongate bar formed of semi-rigid synthetic material of thickness between 200 and 1000 micron, this bar resting on the other surface of said sheet and being disposed in the direction of the length of the sheet, the two ends of the bar being bonded to said sheet in correspondence of the two end portions of the same bar.

It is to be noted that in this description and in the claims, the words "flexible sheet" are applied both to a compact, uniform layer of material, and to fabric of any known type.

Preferably the skin-compatible adhesive is an acrylic polymer with water or skin-compatible solvents, which is spread in a quantity between 20 g and 90 g of dry polymer per $m^2$ of the sheet surface. Again preferably, the quantity of dry polymer is 40 g per $m^2$ of sheet.

Experience has shown that advantageously the sheet thickness is about 70 micron and that the bar thickness is about 400 micron and the bar width is between 1.5 and 4 cm.

To form the sheet (even if it is a fabric), soft or plasticized PVC, polyurethane, polyethylene, polyester or other materials of the same characteristics can be usefully used, whereas the bar is advantageously formed of semi-rigid PVC or other similar material.

As in the case of common adhesive plasters, a sheet of silicone-coated paper or the like can be applied to the layer of adhesive material, to be removed at the moment at which the breast support is to be used.

The structure, characteristics and use of the self-sustaining female breast support will be more apparent from the ensuing description of one embodiment thereof given by way of non-limiting example with reference to the accompanying drawing, in which:

FIG. 1 is a perspective view of the breast support, showing the part in which the semi-rigid bar is present;

FIG. 2 is a section through the breast support on the line 2—2 of FIG. 1;

FIG. 3 shows the left portion of FIG. 2 on an enlarged scale; and

FIG. 4 shows two breast supports applied to two female breasts.

With reference firstly to FIGS. from 1 to 3, these show that the breast support consists of a thin compact sheet 1 or fabric layer of elongate shaped form, there being applied on that surface visible in FIG. 1 a bar 2 extending in the longitudinal direction of the sheet 1, to which only the two ends of the bar 2 (in correspondence of the zone quoted with number 4) are heat-bonded by usual methods: the term "heat-bonded" is intended to cover also the case in which the sheet 1 and the bar 2 are simply glued one onto the other in correspondence of the zone 4.

The sheet 1 (which can for example be 12 or 14 or respectively 19 cm long and from 3 to 5 cm large, usually about 4.5 cm large, for breasts of 1st or 2nd or respectively 3rd size) has a thickness between 20 and 150 micron, preferably about 70 micron, and can be formed of soft or plasticized PVC (possibly transparent), polyurethane, polyester, polyethylene or other equivalent like materials, both as plain sheets and as fabric sheets.

The bar 2 (which preferably is somewhat shorter than the sheet 1 and is form 2 to 4 cm wide) has a thickness between 200 and 1000 micron, preferably about 400 micron, and can be advantageously formed of semi-rigid PVC of high elasticity (again possibly transparent) or of other equivalent materials.

That surface of the sheet 1 distant from the surface on which the bar 2 is present is covered by a uniform layer of skin-compatible adhesive, for example an acrylic polymer with water or solvents. This adhesive is spread on the surface of the sheet 1 by well known traditional methods and machines in a quantity from 20 g to 90 g (preferably about 40 g) of dry adhesive per $m^2$ of the sheet surface.

In a manner similar to all adhesive plasters, the layer of adhesive material is covered and protected with a sheet of silicone-coated paper or the like 3 which is removed at the moment in which the breast support is to be used.

It has not been possible to show and indicate by reference numeral the layer of adhesive in the figures as it is extremely thin, but it is sufficient to note that, with reference to FIGS. 2 and 3, it is interposed between the sheet of silicone-coated paper and the adjacent surface of the sheet 1.

It will now be assumed that the described breast support is to be used. The woman who wishes to use it lifts each breast upwards with one hand (possibly while lying on her back) and applies the breast support to it from below so that it adheres to the skin and is hence self-sustaining (FIG. 4).

It is important to note that the bar 2 acts elastically as a leaf spring which tends to return to its flat position and hence to widen the lateral walls of the breast, so pulling it upwards. At the same time the sheet 1, thrust by the bar 2, supports the lower part of the breast and urges it upwards.

The sheet 1 and the bar 2 can be made perfectly transparent (and hence be nearly invisible) or be of any colour.

What is claimed is:

1. A self-sustaining female breast support, comprising:

a thin, flexible, elongate sheet of shaped profile, having a longitudinal direction and a thickness between 20 and 150 microns and formed of soft synthetic material, a thin layer of skin-compatible adhesive at least partly covering a surface of said sheet, and an elongate bar having at least two ends and formed of semi-rigid synthetic material of thickness between 200 and 1000 microns, the bar resting on another surface of said sheet and being disposed in the longitudinal direction of the sheet, the two ends of the bar being bonded to said sheet at corresponding portions of the sheet.

2. A breast support as claimed in claim 1, wherein the skin-compatible adhesive consists of an acrylic polymer with water or with skin-compatible solvents, which is spread in a quantity between 20 g and 90 g of dry polymer per $m^2$ of the sheet surface.

3. A breast support as claimed in claim 2, wherein said quantity of dry polymer is about 40 g per $m^2$ of the sheet surface.

4. A breast support as claimed in claim 1 wherein the sheet thickness is about 70 microns, the bar thickness is about 400 microns, and the bar width is between 1.5 and 4 cm.

5. A breast support as claimed in claim 1 wherein said sheet is formed of soft or plasticized PVC, polyurethane, polyethylene or polyester, the bar being formed of semi-rigid PVC.

6. A breast support, comprising:

a thin, flexible elongate sheet having a longitudinal direction and formed of soft synthetic material, a thin layer of a skin-compatible adhesive at least partly covering a first surface of said sheet, and an elongate member bonded to a second surface of the sheet opposite the first surface and disposed on the sheet in the longitudinal direction of the sheet, the elongate member having greater rigidity than the sheet, and wherein a thickness of the sheet is between 20 and 150 microns, and wherein a thickness of the elongate member is between 200 and 1000.

7. A breast support as claimed in claim 6, wherein the skin-compatible adhesive consists of an acrylic polymer with water or with skin-compatible solvents, which is spread in a quantity between 20 g and 90 g of dry polymer per $m^2$ of the first surface.

8. A breast support as claimed in claim 7, wherein said quantity of dry polymer is about 40 g per $m^2$ of the first surface.

9. A breast support as claimed in claim 6 wherein a thickness of the sheet is about 70 microns, a thickness of the elongate member is about 400 microns, and a width of the elongate member is between 1.5 and 4 cm.

10. A breast support as claimed in claim 6 wherein said sheet is formed of soft or plasticized PVC, polyurethane, polyethylene, or polyester, and wherein the elongate member is formed of semi-rigid PVC.

11. A breast support as claimed in claim 6, wherein the elongate member is bonded to the sheet at a first end of the elongate member and at a second end of the elongate member.

* * * * *